US009291411B2

(12) United States Patent
Zonshine

(10) Patent No.: US 9,291,411 B2
(45) Date of Patent: Mar. 22, 2016

(54) FIREARM WITH PIVOTING BARREL-RECEIVER ASSEMBLY

(71) Applicant: Sturm, Ruger & Company, Inc., Southport, CT (US)

(72) Inventor: Amir Zonshine, Phoenix, AZ (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/321,323

(22) Filed: Jul. 1, 2014

(65) Prior Publication Data

US 2015/0247688 A1 Sep. 3, 2015

Related U.S. Application Data

(60) Provisional application No. 61/841,819, filed on Jul. 1, 2013.

(51) Int. Cl.

| | |
|---|---|
| ***F41A 21/48*** | (2006.01) |
| ***F41A 3/58*** | (2006.01) |
| ***F41A 11/00*** | (2006.01) |
| *F41A 3/66* | (2006.01) |

(52) U.S. Cl.
CPC . *F41A 3/58* (2013.01); *F41A 11/00* (2013.01); *F41A 3/66* (2013.01)

(58) Field of Classification Search
CPC ..... F41A 21/48; F41A 21/484
USPC ..... 42/8, 40, 51, 69.02
See application file for complete search history.

(56) References Cited

U.S. PATENT DOCUMENTS

| | | | | |
|---|---|---|---|---|
| 970,307 A | | 9/1910 | Clement | |
| 1,363,262 A | | 12/1920 | North | |
| 2,354,025 A | | 7/1944 | Johnson | |
| 2,372,614 A | | 3/1945 | Swebilius | |
| 2,809,457 A | * | 10/1957 | Simpson | 42/75.01 |
| 3,153,874 A | * | 10/1964 | Merrill | 42/41 |
| 3,318,192 A | | 5/1967 | Miller et al. | |
| 3,380,183 A | | 4/1968 | Miller et al. | |
| 3,675,534 A | | 7/1972 | Beretta | |
| 4,407,085 A | | 10/1983 | Hillberg et al. | |
| 4,541,192 A | | 9/1985 | Flodman et al. | |

(Continued)

FOREIGN PATENT DOCUMENTS

| | | |
|---|---|---|
| EP | 0218489 | 4/1987 |
| GB | 156518 | 11/1921 |

OTHER PUBLICATIONS

Corresponding International Search Report and Written Opinion for PCT/US14/45096 dated Mar. 24, 2015.

*Primary Examiner* — Michael David
(74) *Attorney, Agent, or Firm* — The Belles Group, P.C.

(57) ABSTRACT

A firearm with tilting barrel-receiver assembly. In one embodiment, the firearm includes a frame and a barrel-receiver assembly pivotably mounted to the frame. The barrel-receiver assembly is movable between an open position and a closed position. A latching mechanism may include a slide plate configured to selectively engage the frame. The latching mechanism is movable between a locked position wherein the barrel-receiver assembly is held in the closed position by the slide plate and an unlocked position wherein the barrel-receiver assembly is movable to the tilted open position. The slide plate may be spring biased into the locked position. An actuator button cooperates with the slide plate for moving the latching mechanism between the locked and unlocked positions.

19 Claims, 16 Drawing Sheets

(56) References Cited

U.S. PATENT DOCUMENTS

| | | | | |
|---|---|---|---|---|
| 4,722,148 | A * | 2/1988 | Walker | 42/69.01 |
| 4,964,232 | A | 10/1990 | Mainland et al. | |
| 4,999,939 | A * | 3/1991 | Reese et al. | 42/40 |
| 5,225,619 | A | 7/1993 | Sharp | |
| 5,349,773 | A * | 9/1994 | Sprangers | 42/42.02 |
| 5,404,863 | A | 4/1995 | Poor | |
| 5,467,549 | A | 11/1995 | Rowlands et al. | |
| 5,933,998 | A | 8/1999 | Plebani | |
| 6,293,040 | B1 | 9/2001 | Luth | |
| 6,526,683 | B1 * | 3/2003 | Crandall | 42/40 |
| 6,578,565 | B2 | 6/2003 | Casas Salva | |
| 6,604,311 | B1 | 8/2003 | Laney et al. | |
| 6,655,065 | B1 | 12/2003 | Chapman | |
| 6,766,795 | B1 * | 7/2004 | Sullivan | 124/56 |
| 6,820,361 | B2 * | 11/2004 | Popikow | 42/44 |
| 6,907,687 | B2 | 6/2005 | Rousseau et al. | |
| 6,935,063 | B1 | 8/2005 | Johnson | |
| 6,952,895 | B1 * | 10/2005 | Zonshine | 42/70.02 |
| 7,065,913 | B2 * | 6/2006 | Lizarralde et al. | 42/51 |
| 7,316,092 | B2 * | 1/2008 | DeLeeuw | 42/51 |
| 7,353,742 | B1 * | 4/2008 | Sirkis et al. | 89/196 |
| 7,739,821 | B1 | 6/2010 | Hamme | |
| 7,861,640 | B2 | 1/2011 | Lippard | |
| 7,908,781 | B2 * | 3/2011 | Laney et al. | 42/51 |
| 7,987,763 | B1 * | 8/2011 | Sirkis et al. | 89/196 |
| 8,087,344 | B2 | 1/2012 | Siddle et al. | |
| 8,132,348 | B1 | 3/2012 | Post | |
| D661,767 | S * | 6/2012 | Siddle et al. | D22/103 |
| 8,296,985 | B2 | 10/2012 | Krutil et al. | |
| D681,147 | S | 4/2013 | Barker et al. | |
| 8,495,831 | B1 | 7/2013 | Kohout | |
| 8,701,326 | B2 * | 4/2014 | Zonshine | 42/77 |
| 8,950,100 | B2 * | 2/2015 | Nebeker et al. | 42/108 |
| 2001/0029688 | A1 | 10/2001 | Beretta | |
| 2004/0144008 | A1 | 7/2004 | Popikow | |
| 2007/0039222 | A1 | 2/2007 | Lizarralde et al. | |
| 2007/0074437 | A1 | 4/2007 | Compton et al. | |
| 2008/0005951 | A1 | 1/2008 | Gorzen | |
| 2008/0173168 | A1 | 7/2008 | Gussalli Beretta | |
| 2010/0281732 | A1 | 11/2010 | Laney et al. | |
| 2010/0287805 | A1 | 11/2010 | Beckmann et al. | |
| 2011/0185614 | A1 | 8/2011 | Laney et al. | |
| 2012/0159829 | A1 | 6/2012 | Krutil et al. | |
| 2012/0279105 | A1 | 11/2012 | Emde et al. | |
| 2013/0145669 | A1 * | 6/2013 | Zonshine | 42/75.02 |
| 2014/0165442 | A1 * | 6/2014 | Nebeker et al. | 42/16 |

* cited by examiner

FIREARM WITH PIVOTING BARREL-RECEIVER ASSEMBLY

CROSS-REFERENCE TO RELATED APPLICATIONS

The present application claims the benefit of U.S. Provisional Patent Application Ser. No. 61/841,819 filed Jul. 1, 2013, which is incorporated herein by reference in its entirety.

BACKGROUND OF THE INVENTION

The present disclosure generally relates to firearms, and more particularly to a pistol with a tilting barrel-receiver assembly.

Semi-automatic pistols generally include a grip frame having a grip portion for grasping by the user, barrel defining a chamber for holding a cartridge, trigger-actuated firing mechanism for cocking and releasing a striker or hammer to detonate the cartridge, and an axially reciprocating breech block. The breach block defines a breech face for forming an openable and closeable breech with the rear of the chamber for firing the pistol and ejecting spent cartridge casings in a manner well known in the art. Portions of the frame below the barrel and breech block generally house components of the firing mechanism.

Ready access to foregoing components of the pistol is desired for periodic inspection and maintenance.

SUMMARY OF THE INVENTION

A firearm which may be in the form of a pistol according to non-limiting embodiments of the present disclosure provides a pivoting and tilting barrel-receiver assembly with latching mechanism. This advantageously allows the assembly to be pivotably moved between a closed and open position for quick access to components for inspection and maintenance. The latching mechanism is movable between locked and unlocked positions to prevent movement of the barrel-receiver assembly from the closed position or alternatively to allow the barrel-receiver assembly to be opened. In one embodiment, the latching mechanism includes a slide plate which axially engages or disengages a portion of the pistol grip frame to lock or unlock the barrel-receiver assembly respectively, as further described herein.

In one embodiment, a firearm with tilting barrel-receiver assembly includes a longitudinal axis, a frame, a barrel-receiver assembly pivotably supported by the frame, the barrel-receiver assembly angularly movable between a tilted open position and a closed position, and a latching mechanism disposed in the barrel-receiver assembly. The latching mechanism includes a slide plate configured and operable to selectively engage or disengage the frame. The slide plate is slideably movable between a locked position in which the barrel-receiver assembly is retained in the closed position, and an unlocked position in which the barrel-receiver assembly is movable to the open position. The firearm may further comprise a vertically oriented latch pin mounted to the frame which is engaged or disengaged by the slide plate.

In another embodiment, a pistol with tilting barrel-receiver assembly includes a longitudinal axis, a grip frame defining a front trigger guard portion and a rear magazine well, a a barrel-receiver assembly pivotably supported by the frame, the barrel-receiver assembly including a barrel coupled to a receiver, the barrel-receiver assembly angularly movable between a tilted open position and a closed position, a reciprocating bolt movably disposed in the barrel-receiver assembly for forward and rearward movement along the longitudinal axis, a bolt stop pin rigidly attached to the frame, the bolt stop pin arranged to engage the bolt to limit the forward movement of the bolt, and a latching mechanism disposed in the barrel-receiver assembly, the latching mechanism including a slide plate configured and operable to slidably engage the bolt stop pin in a locking manner. The slide plate is axially movable between a locked position in which the slide plate engages the bolt stop pin to prevent the barrel-receiver assembly from being moved out of the closed position, and an unlocked position in which the slide plate disengages the bolt stop pin to allow the barrel-receiver assembly to move to the open position.

A method for operating a firearm with tilting barrel-receiver assembly includes: providing a firearm including a longitudinal axis and a frame supporting a barrel-receiver assembly pivotably movable from a closed position to a tilted open position; moving the barrel-receiver assembly from the open to closed position; inserting a latch pin disposed in the frame through a slide plate movably disposed in the barrel-receiver assembly; axially sliding a slide plate in a first direction into mutual engagement with the latch pin; and locking the barrel-receiver assembly in the closed position wherein the barrel-receiver assembly cannot be moved to the open position.

BRIEF DESCRIPTION OF THE DRAWINGS

The features of the exemplary embodiments will be described with reference to the following drawings where like elements are labeled similarly, and in which.

Figure 1:
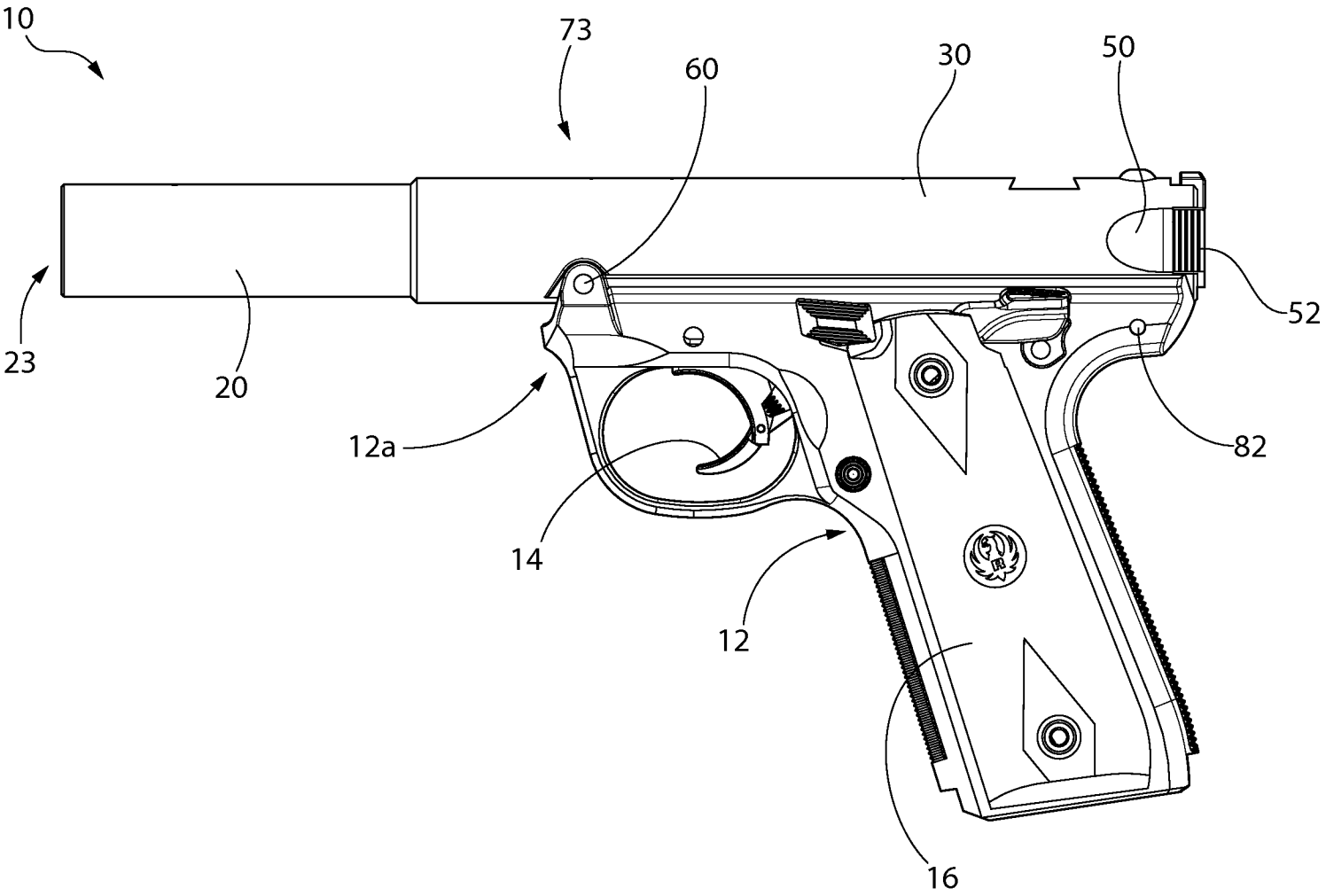
FIG. 1 is a side view of an exemplary pistol with tilting barrel-receiver assembly in a closed position according to the present disclosure.

All drawings are schematic and not necessarily to scale.

DESCRIPTION OF EXEMPLARY EMBODIMENTS

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise.

Figure 2:
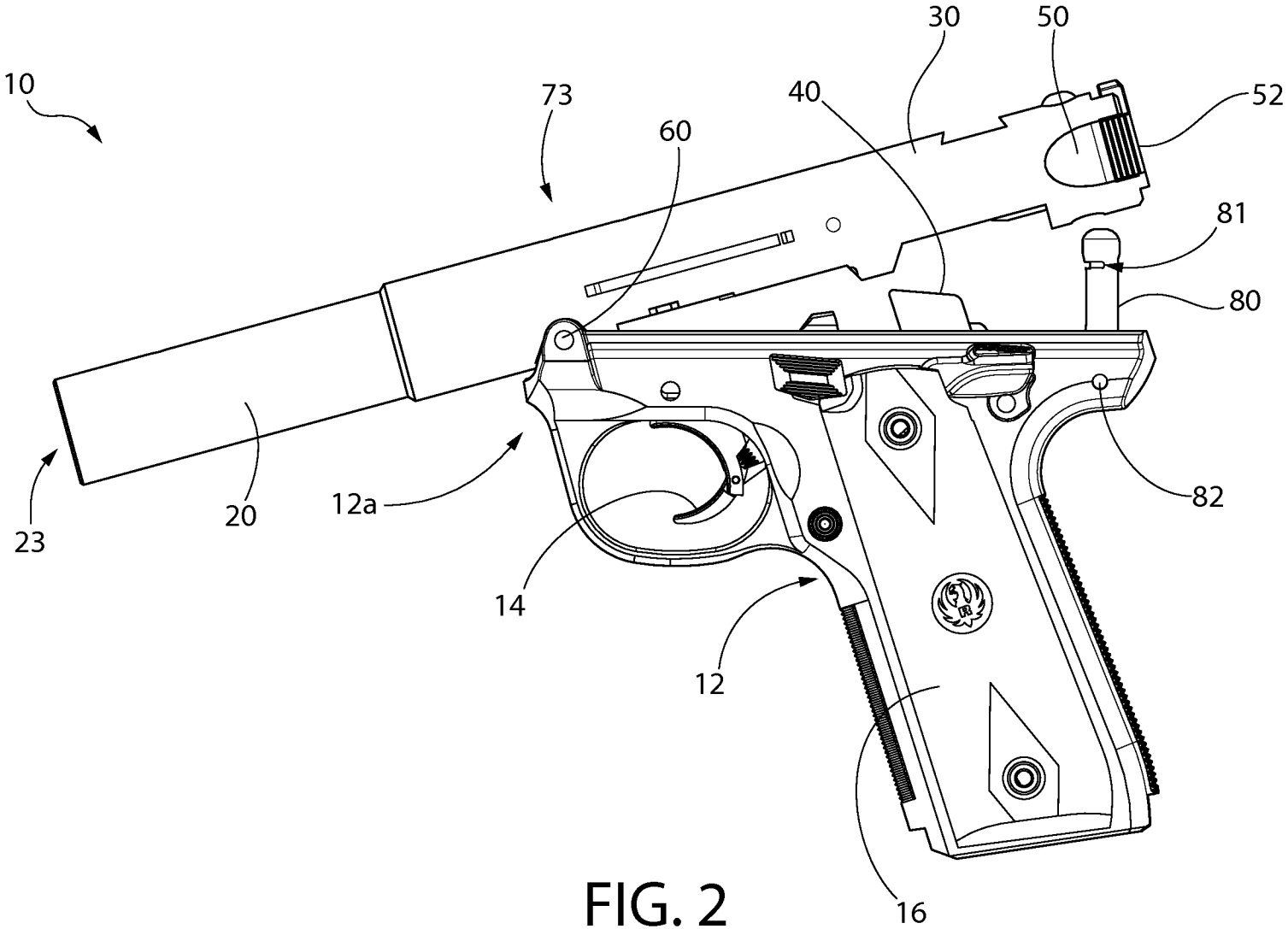
FIG. 2 is a view thereof in an open position.

FIGS. 1 and 2 depict an exemplary embodiment of a semi-automatic firearm in the non-limiting form of a pistol having a pivotable and tilting barrel-receiver assembly according to the present disclosure. It will be appreciated that the present invention is not limited to application in pistols, but may instead be broadly used in other types of firearms including without limitation rifles, shotguns, etc. in which a tilting barrel-receiver assembly is desirable.

Pistol 10 defines a longitudinal axis LA and includes a grip frame 12 having a front trigger guard portion 12*a* and a barrel-receiver assembly including a barrel 20 and receiver 30. In one embodiment, the barrel-receiver assembly 20/30 is formed as a single unitary structure with the barrel being integral with the receiver. In other embodiments, the barrel 20 may be a separate component which is permanently or removably coupled to the front of the receiver 30. The rear of the frame 12 defines an elongated grip 16 for holding pistol 10. The frame 12 includes an at least partially open interior space 11 for housing the firing mechanism components (see, e.g. FIGS. 5 and 6). A portion of interior space 11 in grip 16 further defines a magazine well 13 configured to hold a removably insertable magazine (not shown) that contains a plurality of cartridges. Frame 12 may be made of any suitable material commonly used in the art including metal, polymer (e.g., glass reinforced or unreinforced nylon or other plastic), or combinations thereof.

Pistol 10 includes a trigger-actuated firing mechanism including a trigger 14 which is operable to cock and release a pivotable hammer 40 (see, e.g. FIGS. 5 and 6) in one embodiment. Other possible embodiments may instead comprise an axially reciprocating-cockable striker in lieu of a hammer which are well known to those skilled in the art without further elaboration. The hammer assembly may further include a hammer strut 41 and spring 42 operable to bias the hammer 40 in a forward direction towards an axially movable firing pin 43. Trigger 14 is mechanically linked to hammer 40 and a rotatable sear 44 via trigger bar 45. The trigger bar is operable to cock hammer 40 into a rearward ready-to-fire position. Sear 44 operates to hold the hammer in the rearward cocked position. Pulling trigger 14 rotates the sear 44, which in turn releases the hammer 40 to strike the rear end of firing pin 43. The front end of the firing pin strikes a chambered cartridge and discharges the pistol 10.

Figure 5:
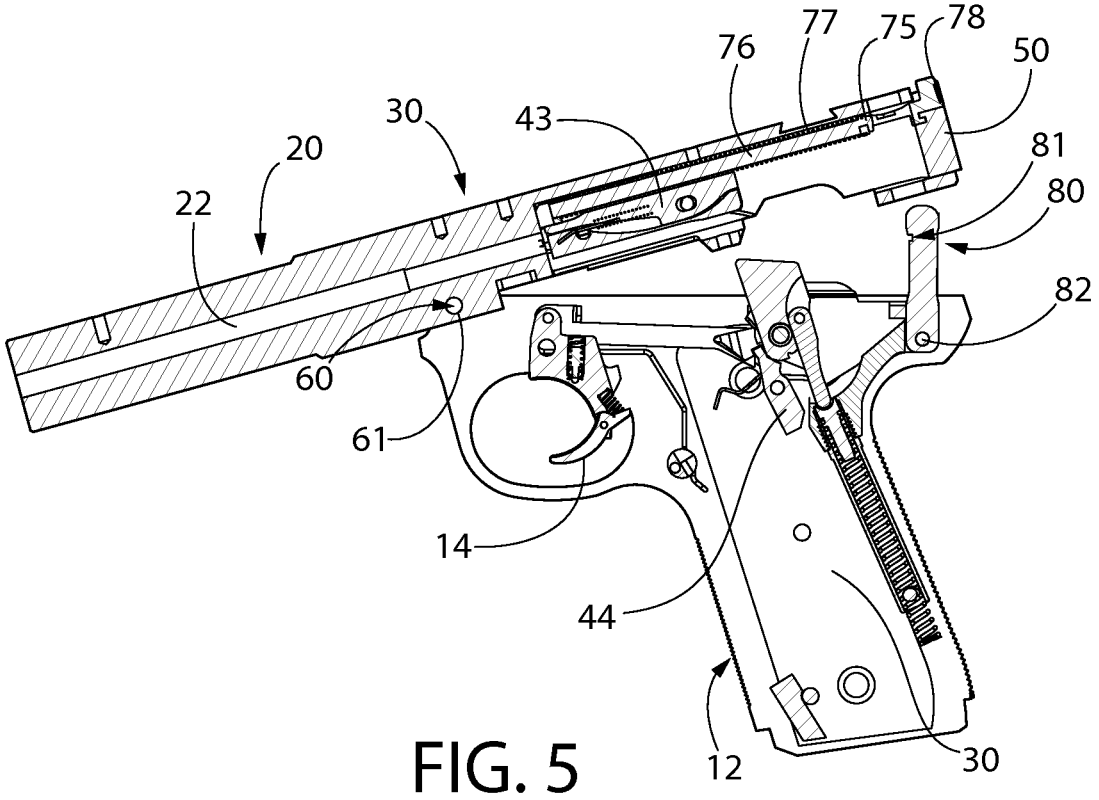
FIG. 5 is a side cross-sectional view of the grip frame and barrel-receiver assembly showing the barrel-receiver assembly in an open position.
Figure 6:
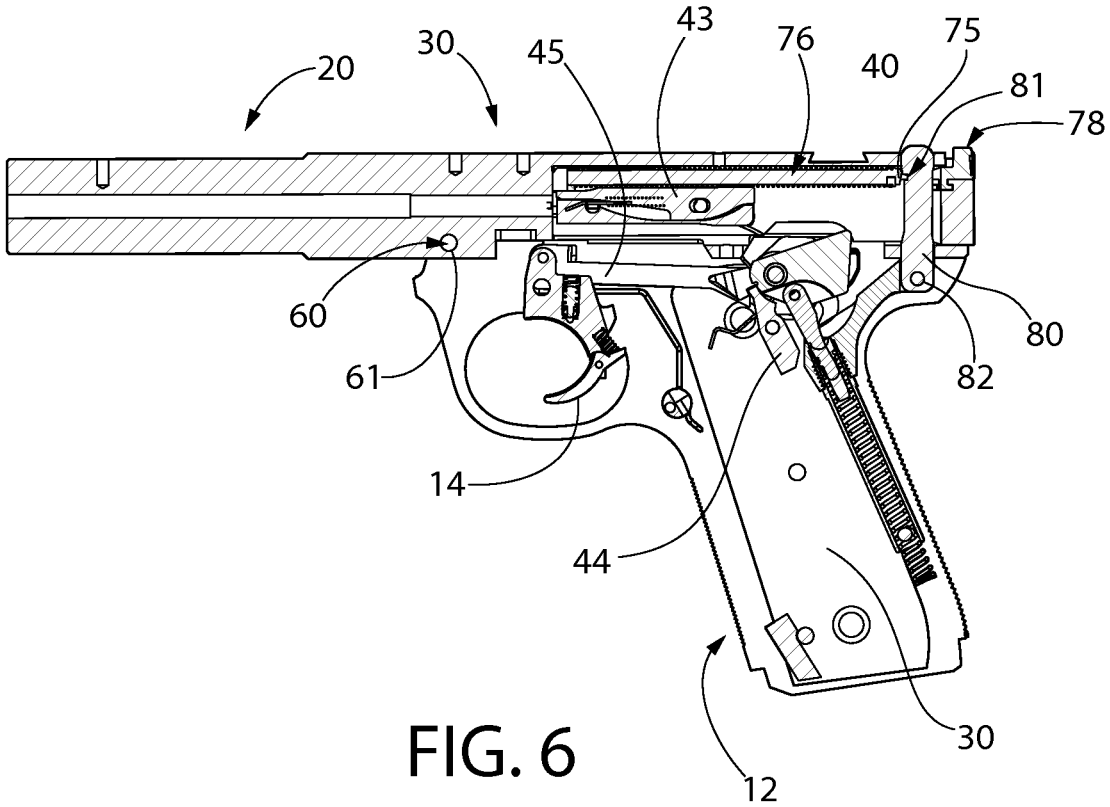
FIG. 6 is a side cross-sectional view thereof with the barrel-receiver assembly in a closed position.
Figure 7:
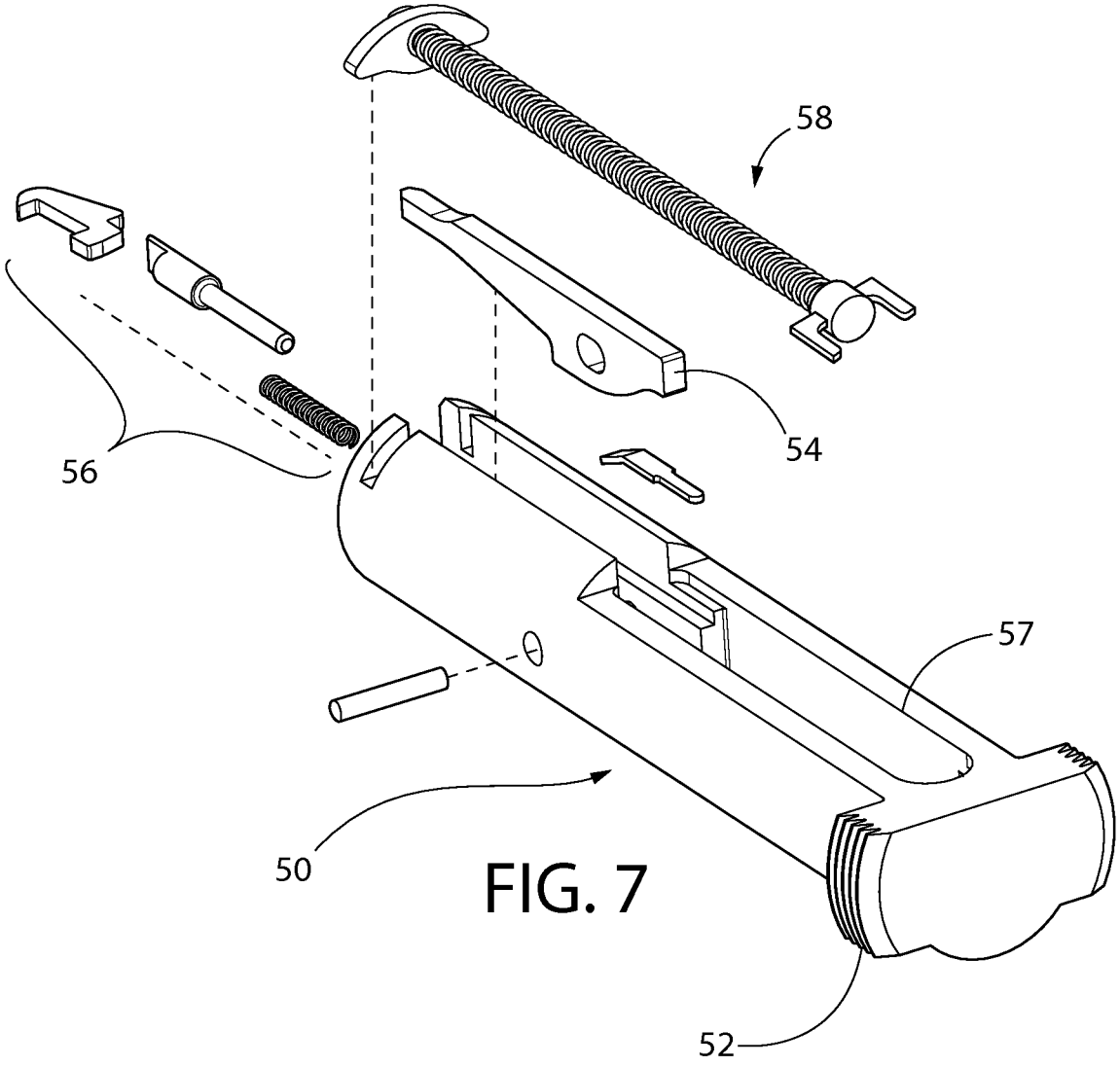
FIG. 7 is an exploded perspective view of an exemplary reciprocating bolt disposed in the barrel-receiver assembly of the pistol of FIG. 1.
Figure 8:
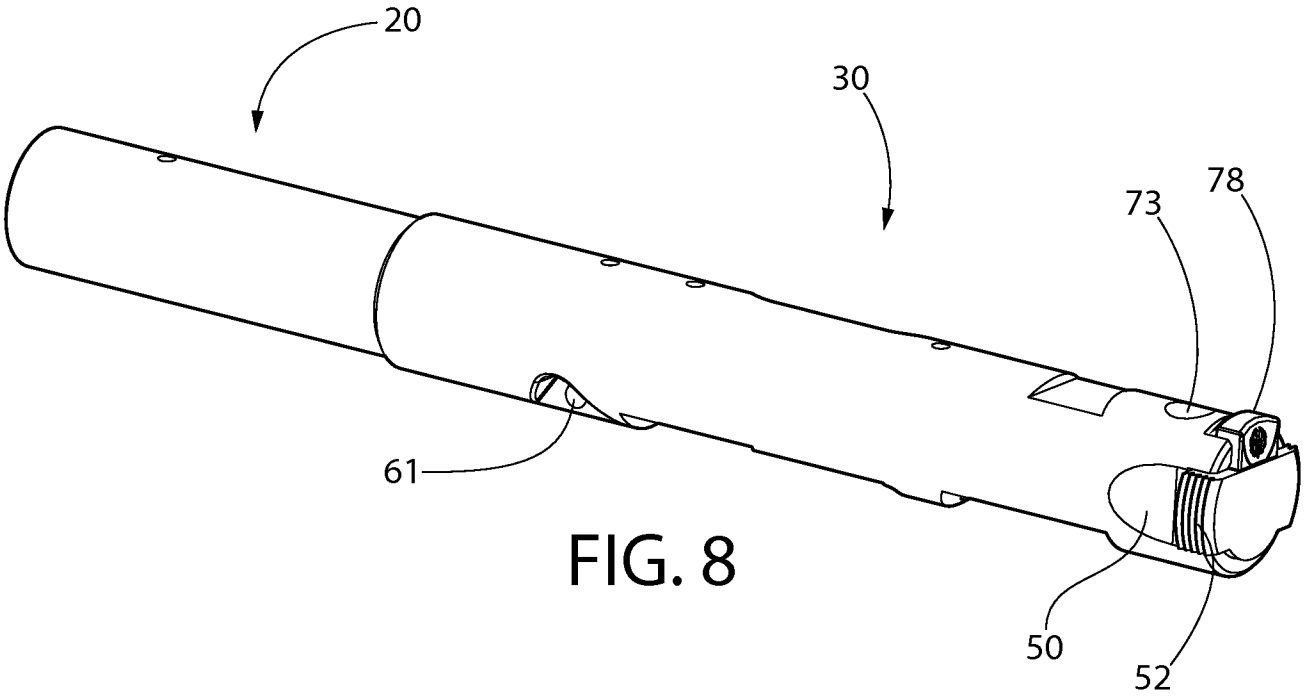
FIG. 8 is a perspective view of a barrel-receiver assembly and bolt slidably disposed therein.
Figure 9:
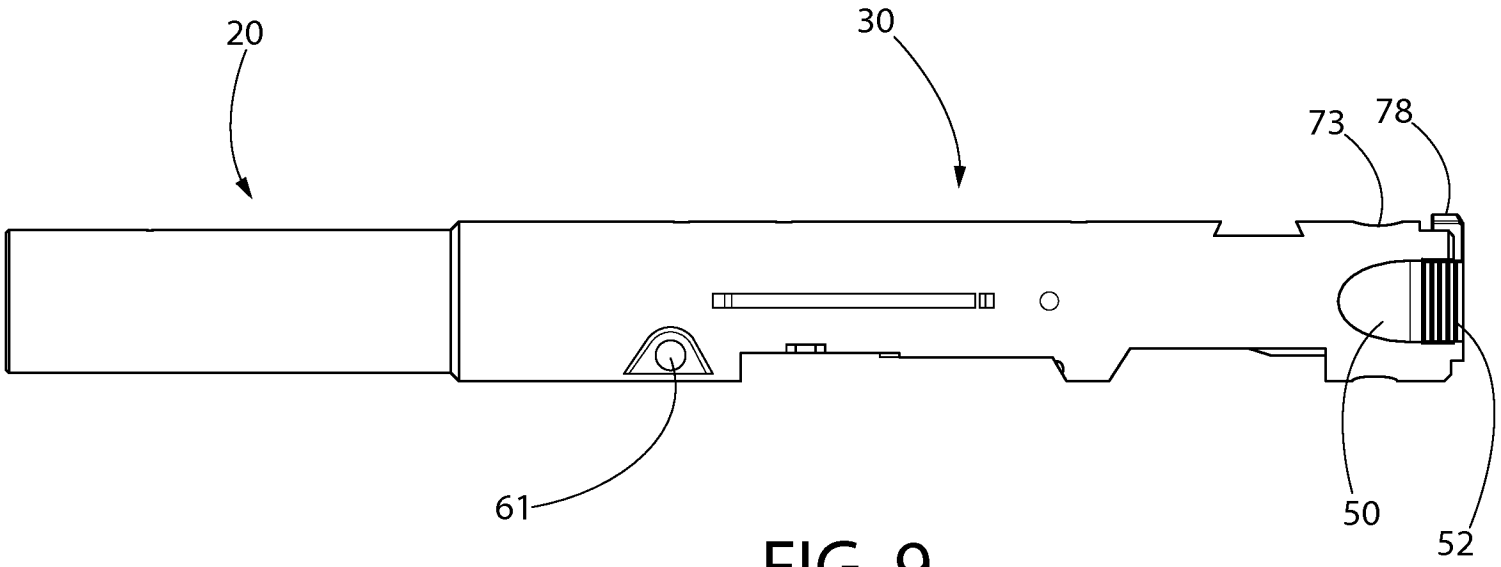
FIG. 9 is a side elevation view thereof.
Figure 10:
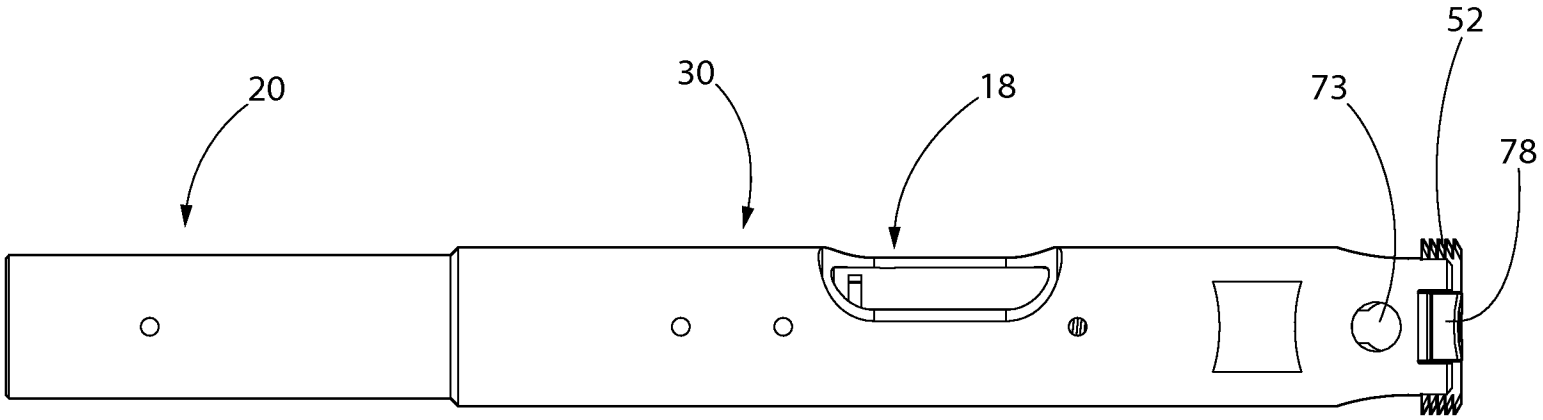
FIG. 10 is a top plan view thereof.
Figure 11:
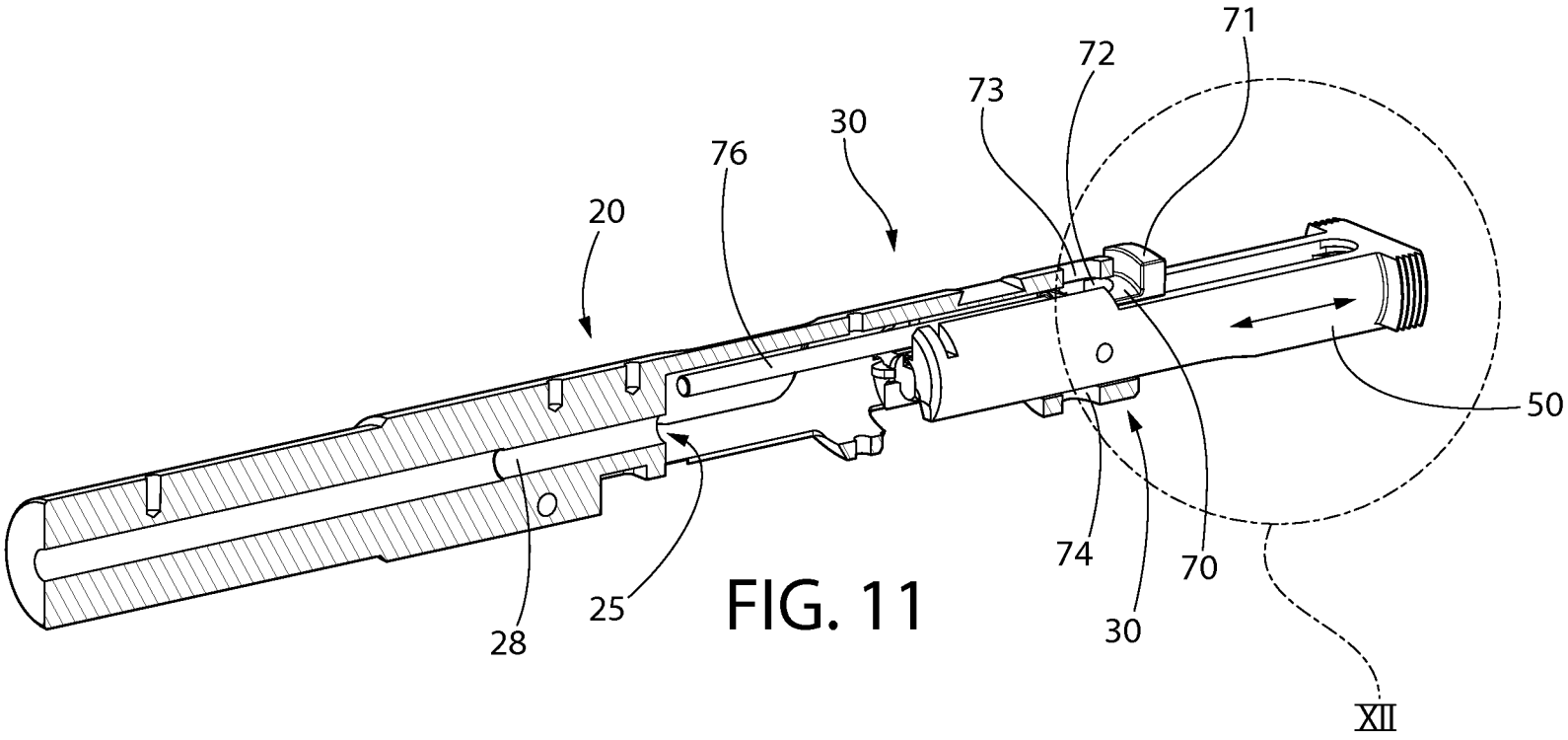
FIG. 11 is a side perspective cross-sectional view thereof.

A spring-biased reciprocating bolt 50 is provided having opposing laterally projecting bolt ears 52 at the rear for manually retracting the bolt (see, e.g. FIGS. 1-2 and 5-12). Bolt 50 is generally cylindrical in shape as best shown in FIG. 7 and slidably mounted inside receiver 30 for rearward and forward reciprocating movement in recoil upon discharging the pistol. The forward face of the bolt 50 defines the breech face. In some embodiments, bolt 50 is made of steel or an alloy thereof suitable for withstanding the combustion forces generated when detonating a cartridge while maintain a closed breech thereby supporting the rim area of the cartridge. Bolt 50 includes a firing pin assembly 54 for striking a chambered cartridge and a cartridge extractor assembly 56 as will be well known in the art (see, e.g. FIG. 7). In one embodiment, bolt 50 further includes an axially elongated slot 57 through which a bolt stop pin 80 projects (see FIGS. 6, 7, 11, and 15). This slot allows the bolt 50 to slide around and past the bolt stop pin 80 both forward/rearward during recoil or when manually opening the breech. The rear end of the slot 57 may be arcuately curved and serves as a bolt stop to limit the forward movement and position of the bolt 50 when the breech is closed.

In operation, pulling the trigger 14 releases the hammer which strikes and drives the firing pin forward to detonate the cartridge in the manner described above. This in turn drives the bolt 50 rearward (within the receiver 30 which remains axially fixed in position on grip frame 12) under the recoil forces to extract and eject the cartridge casing through an ejection port 18 in the side of the receiver 30. The bolt 50 is returned forward under the biasing force of a recoil spring 58. The foregoing type of bolt firing mechanism may be found, for example without limitation, in a Ruger Mark III pistol available from Sturm, Ruger & Company, Inc. of Southport, Conn. However, it will be noted that embodiments of a barrel system and bolt mechanism according to the present disclosure are expressly not limited in use to this particular pistol and may be applied with equal benefit to other type pistols and rifles.

FIGS. 1-12 show various views of the pistol, barrel-receiver assembly 20-30, and related components.

Barrel 20 includes an open front muzzle end 23 and an open rear end 25. Barrel 20 is axially elongated and defines a longitudinally-extending bore 22 extending therethrough that communicates with open ends 23, 25. Bore 22 may be rifled. The rear portion of barrel 20 defines a chamber 28 configured for holding a cartridge to properly support the cartridge casing when firing the pistol 10. In one non-limiting embodiment, the chamber 28 may be configured for holding rimfire type cartridges; however, in certain other embodiments the chamber may be configured for centerfire type cartridges. Both type cartridges are well known to those skilled in the art without further elaboration.

Receiver 30 may be an axially elongated and generally hollow cylindrical structure defining a longitudinally-extending internal cavity 38. Receiver 30 further includes an open front end 31, opposing open rear end 33, and an ejection port 18 (see FIGS. 1-12). Cavity 38 may be generally circular in cross section and may vary in diameter along the length of the receiver. Cavity 38 may extend axially completely through receiver 30 and communicate with open front and rear ends 31, 33 as shown. Open front end 31 of receiver 30 communicates with chamber 28 of the barrel 20 to load cartridges from a magazine not shown for clarity) disposed in magazine well 13 of the grip frame 12 into the chamber and to extract spent cartridges for ejection through ejection port 18 of the receiver. Open rear end 33 allows the rear portion of reciprocating bolt 50 to alternatively project outwards from the receiver 30 under recoil and return at least partially back inside the receiver in a sliding axial motion. Receiver 30 further includes a bottom cartridge feed opening 38*c* that communicates with the magazine well for receiving cartridges from the magazine.

Barrel-receiver assembly 20/30 may be mounted in a pivotable and tilting manner to grip frame 12 via a suitable rotational coupling. The barrel-receiver assembly is angularly movable and pivotable between a closed operating (i.e. ready-to-fire) position (FIG. 1) and an open maintenance position (FIG. 2). In the closed position, the barrel-receiver assembly 20/30 and bore 22 of barrel 20 are coaxially aligned with the longitudinal axis LA of pistol 10. In the open position, the barrel-receiver assembly 20/30 and barrel bore 22 are disposed at an angle A1 to the longitudinal axis LA, Angle A1 may be between 0 and 90 degrees, and in some embodiments more than 90 degrees.

Advantageously, the tilting feature provides ready access to the pistol 10 components for inspection and maintenance without requiring the barrel-receiver assembly 20/30 and fasteners (e.g. screws, pins, etc.) to be dismounted from the grip frame 12 and then re-installed. In one embodiment, no tools are required to open and close the barrel-receiver assembly 20/30. This allows a user to readily open and inspect the pistol even in the field when ready access to tools (e.g. screwdriver, pin punch, hammer, pliers, etc.) may not be available.

In one arrangement, grip frame 12 includes a lateral pivot pin 60 which engages a transverse mounting hole 61 in barrel-receiver assembly 20/30 to rotationally couple the barrel-receiver assembly to the frame (see, e.g. FIGS. 1, 2, 5, and 6). In one embodiment, mounting hole 61 may be disposed proximate to the bottom of the barrel-receiver assembly. Pivot pin 60 defines a pivot axis for rotating and tilting barrel-receiver assembly 20/30. The pivot pin 60 may be positioned near the front top end of the trigger guard portion 12*a* of grip frame 12 so that the barrel-receiver assembly 20/30 may be pivoted or tilted without interference from the grip frame.

According to one aspect of the present invention, as shown in FIGS. 3-6, pistol 10 further includes a manually-operated latching mechanism 100 which is operable to lock and unlock the barrel-receiver assembly 20/30 to grip frame 12. In one embodiment, the latching mechanism may comprise an assembly of a spring-biased slide plate 70, spring 76, elongated spring guide rod 76, and actuator button 78. Rod 76 is longitudinally oriented and disposed in receiver 30. In one embodiment, without limitation, spring 77 may be a helical compression spring having coils disposed around the rod 76 which act on the front end of and biases a slide plate 70 axially rearwards towards engagement with bolt stop pin 80. Other suitable types of spring (e.g. torsion springs, etc.) may be used which provide similar operability.

The latching mechanism 100 is configured to selectively engage and disengage the grip frame 12 or an appurtenance thereof to (1) lock the pivoting barrel-receiver assembly 20/30 in the closed position on the grip frame during operation of the pistol (see, e.g. FIG. 1), and (2) to unlock the barrel-receiver assembly so that the assembly may be pivoted to the tilted open position (see, e.g. FIG. 2).

FIGS. 16-22 illustrate different views of a slide plate 70 with an integral actuator button 78.

Slide plate 70 is substantially horizontally oriented and may be laterally broadened with respect to adjoining portions of rod 76 as shown in one embodiment. Accordingly, slide plate 70 in some configurations may have a lateral width (measured transversely to longitudinal axis LA) which is larger than the diameter of rod 76. In one embodiment, slide plate 70 may have a slightly arcuately curved convex top surface 70*a* (best shown in FIG. 22) when viewed in lateral transverse cross-section to conform to the arcuately curved shape of the top of the tubular receiver 30. Other configurations of the slide plate are suitable and may be used such as a flat top surface for example.

Slide plate 70 is operated with and moved axially in a horizontal direction via actuator button 78, which may be located rearward of the plate in certain embodiments (see, e.g. FIGS. 1-6 and 8-12). In the embodiment shown, button 78 may be a unitary structural part of the slide plate disposed at the rear end of the slide plate. In other possible embodiments, the actuator button 78 may be a separate component rigidly coupled to the slide plate 70 by any suitable means (e.g. snap fit, shrink fit, welding/soldering, adhesives, fasteners, or other) so that sliding the button forward or rearward moves the slide plate 70 in unison therewith. Yet still in other embodiments, the button 78 may remain separate in construct from slide plate 70 and be slideably arranged in the receiver to engage the rear end of the slide plate.

Figure 3:
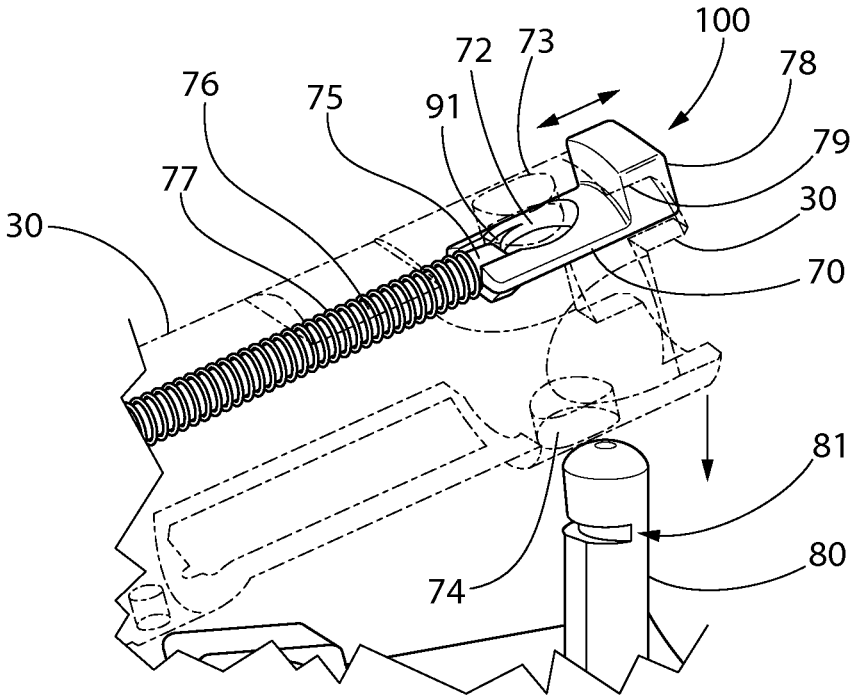
FIG. 3 is a close-up perspective view of a rear portion of the pistol in an open tilted position showing details of a latching mechanism, the receiver being shown in phantom lines.
Figure 4:
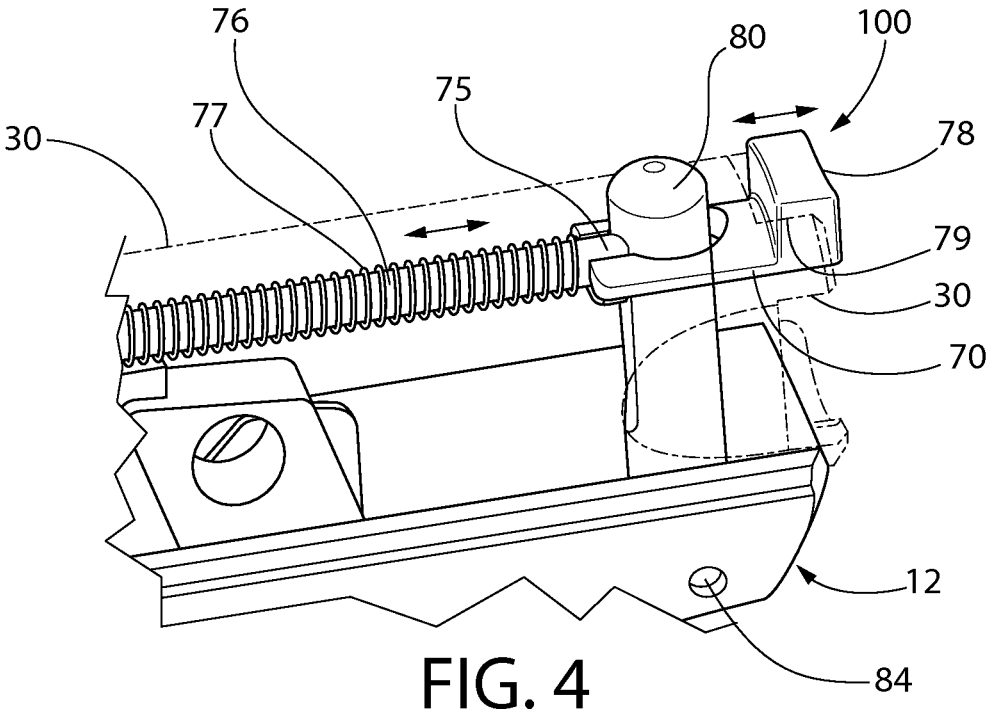
FIG. 4 is an perspective view thereof with the pistol in a closed position.
Figure 14:
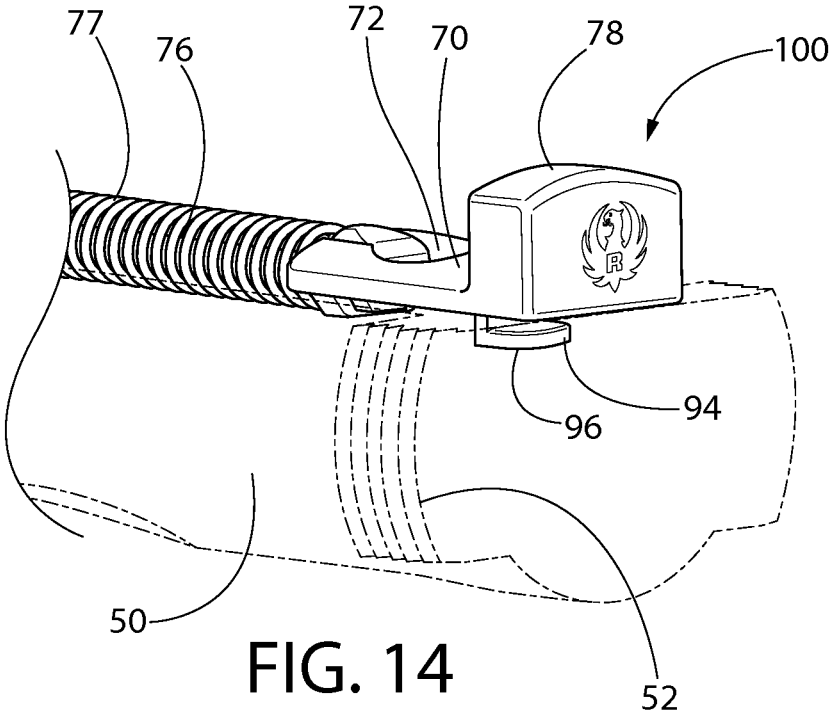
FIG. 14 is an enlarged perspective view of the slide plate with integral operating button and rear end of the bolt shown in phantom lines.
Figure 15:
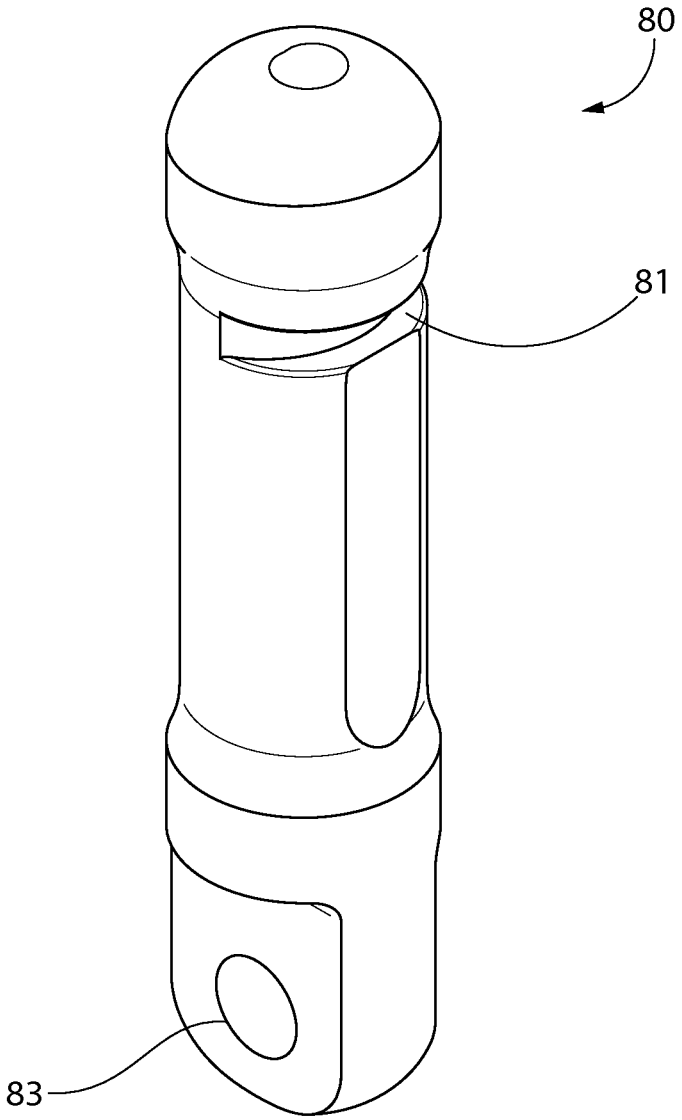
FIG. 15 is a perspective view of latch pin.
Figure 16:
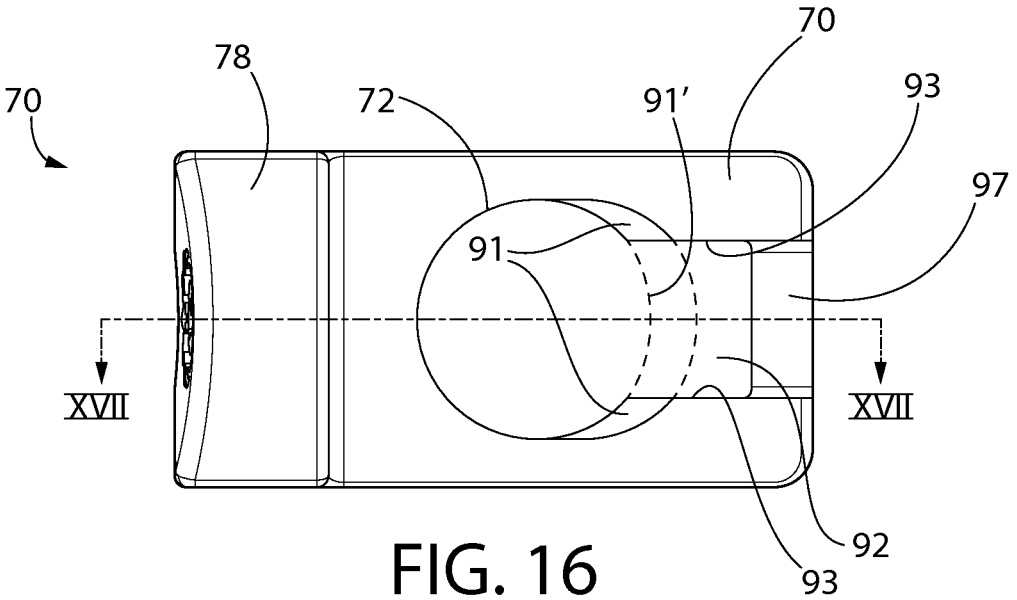
FIG. 16 is a top plan view of the slide plate with integral operating button.

FIGS. 23-27 illustrate different views of the spring guide rod 76. Referring to these figure and FIGS. 3-6, and 14, spring guide rod 76 includes a forward end 98 and opposing rear end 75 configured and arranged to engage the front end of slide plate 70. The rod 76 may be formed as ether an integral unitary structural part of slide plate 70 or alternatively may be a separate component attached to the slide plate. In the latter embodiment, rear end 75 of rod 76 in one configuration may detachably engage the front end of slide plate 70 via a generally snug, but non-permanent connection as shown in FIGS. 3-4 and 14. To create this type of connection, slide plate 70 may include a cross-bar 97 (see, e.g. FIGS. 16-22) spanning laterally across the front end of the actuator button 78 in a direction transverse to longitudinal axis LA when the latching mechanism 100 is mounted in the receiver 30. The rear end 75 of rod 76 may include a hook 99 configured to engage cross-bar 97. A downwardly open slot 101 is formed adjacent and forward of the hook which receives the cross-bar 97 at least partially therein when the hook 99 latches over the cross-bar. The spring 77 which engages the front end of the slide plate 70 keeps the hook 99 engaged with the cross-bar 97.

In other embodiments in which the spring guide rod 76 and slide plate 70 are separate components, the slide plate 70 may be affixed to the rear end 75 of the rod via other suitable mechanical attachment means including without limitation a snap fit, shrink fit, welding/soldering, adhesives, fasteners, or other suitable method.

The slide plate 70 with integral actuator button 78 assembly may be slidably supported by receiver 30 in a rearwardly open elongated channel 79 for rearward and forward axial movement when manually and selectively operated by a user. The actuator button 78 is biased in a rearward axial direction by the slide plate 70 which is urged in the same rearward direction by spring 77, as described herein. The slide plate 70 is axially movable via the actuator button 78 between a forward unlocked axial position of the slide plate disengaged from the grip frame 12 (see, e.g. FIG. 3) and a rearward locked axial position (see, e.g. FIG. 4) engaged with the grip frame. In one embodiment, slide plate 70 may disposed proximate to the rear end 33 of receiver 30 opposite the pivot axis of the barrel-receiver assembly 20/30 at the distal front end 31 of the receiver.

In a locked position shown in FIGS. 4 and 6, slide plate 70 is configured and operable to lockingly engage a forward facing locking slot 81 formed in the grip frame 12. Slot 81 may be formed in a protrusion on grip frame 12 such as without limitation a vertically oriented latch pin mounted to the frame. In the embodiment shown and described herein, the bolt stop pin 80 may also serve as the latch pin thereby combining the dual functions of a latch pin for latching the barrel-receiver assembly 20/30 in the closed position and also as a bolt travel stop for limiting the forward movement and position of the bolt 50 with respect to the barrel 20 and receiver 30. Advantageously, this conserves valuable space within the barrel-receiver assembly 20/30 allowing a more compact pistol platform to be offered. In other possible embodiments contemplated, however, a separate latch pin with locking slot and a bolt stop pin may be provided. The locking slot 81 may be horizontally oriented to engage the horizontally oriented slide plate 70.

Referring to FIGS. 1-6 and 15, bolt stop pin 80 may have a cylindrical body in one embodiment. Bolt stop pin 80 may be metal and affixed to the grip frame 12 of the pistol 10 by any suitable means in one non-limiting embodiment, bolt stop pin 80 may be fixed to grip frame 12 via a lateral mounting pin 82 inserted through opposing holes 84 formed in the sides of the frame (see FIG. 4). The bolt stop pin 80 includes a pin hole 83 for inserting the mounting pin 82 therethrough. Hole 83 may be formed at any suitable location in the bolt stop pin, such as without limitation proximate to the bottom end of the bolt stop pin as shown. The frame 12 is configured to engage the bolt stop pin 80 to prevent the pin from rotating about mounting pin 82, thereby keeping the pin 80 in a stationary position with respect to the frame.

In preferred but non-limiting embodiments, the bolt stop pin 80 may be affixed to the grip frame 12 in a rigid manner which essentially forms a stiff upright post for securely anchoring the barrel-receiver assembly 20/30 in the closed locked position to the frame. This rigid attachment of the bolt stop pin 80 is also advantageous because the bolt stop pin may serve the dual function of both a barrel-receiver assembly 20/30 latch pin and a bolt travel stop which abuttingly engages and arrests the forward return movement of the bolt 50 under recoil after firing the pistol. When the slide plate 70 is in the locked position, the mutual engagement between the slide plate 70 and slotted bolt stop pin 80 prevents the barrel-receiver assembly 20/30 from being tilted upwards about the pivot axis near the front trigger guard portion 12*a* of the grip frame when operating the pistol in firing mode.

The locking slot 81 may be formed proximate to the top end of the bolt stop pin 80 to engage the slide plate 70 disposed in the upper portion of the receiver above the longitudinal cavity 38. The top end of the bolt stop pin 80 may be convexly rounded to facilitate reinsertion back through the locking aperture 72 of the slide plate 70 when closing the barrel-receiver assembly 20/30.

The locking aperture 72 in slide plate 70 in one configuration is configured and arranged to engage a portion of slide plate 70 that is immediately forward of the aperture with the slot 81 in bolt stop pin 80. The locking aperture 72 may be formed as a circular hole in one embodiment which extends vertically completely through slide plate 70 between its top and bottom surfaces. Accordingly, aperture 72 lies substantially in the horizontal plane. The bolt stop pin 80 is insertable vertically through aperture 72 of slide plate 70. When in the locked position as shown in FIGS. 4 and 6, a top end portion of bolt stop pin 80 may protrude upwards beyond the top surface of the slid plate 70 and in some embodiments beyond the top surface of the receiver 30. In one embodiment, receiver 30 may include a pair of vertically spaced apart holes 73 and 74 best shown in FIG. 3 which are concentrically alignable with aperture 72 of slide plate 70 when the barrel-receiver assembly 20/30 is in the locked position in which the bolt stop pin 80 extends vertically through the receiver 30 (see. e.g. FIG. 4). This helps anchor the receiver 30 in the closed locked position via the slide plate 70 which is in turn anchored to the receiver forming a slideably movable locking surface disposed in the receiver.

Figure 17:
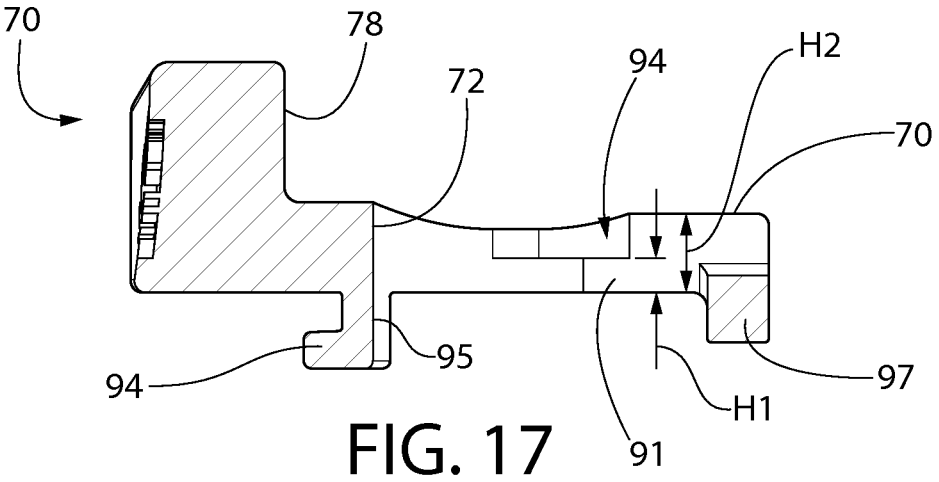
FIG. 17 is side cross-sectional view thereof taken along lines XVII-XVII in FIG. 16.
Figure 18:
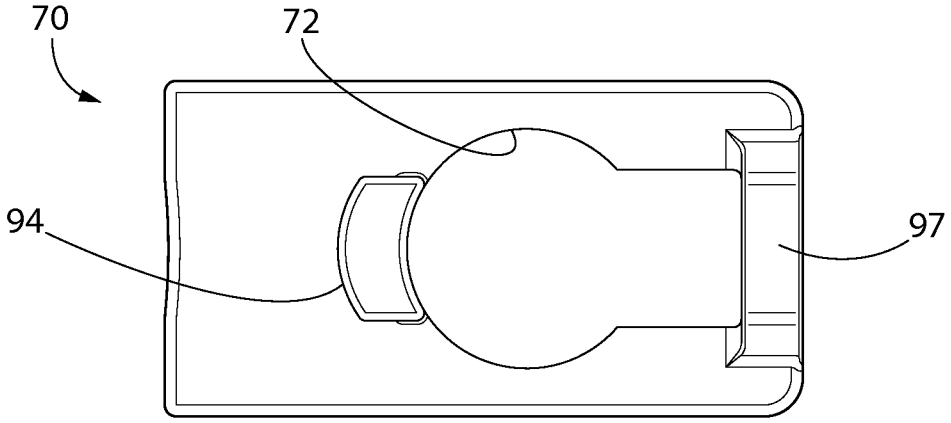
FIG. 18 is a bottom plan view thereof.
Figure 20:
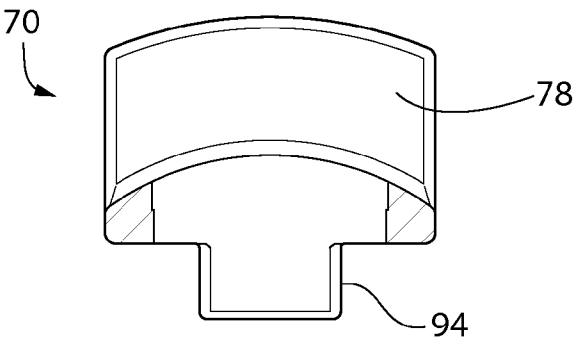
FIG. 20 is a cross-sectional view of taken along lines XX-XX in FIG. 19.
Figure 22:
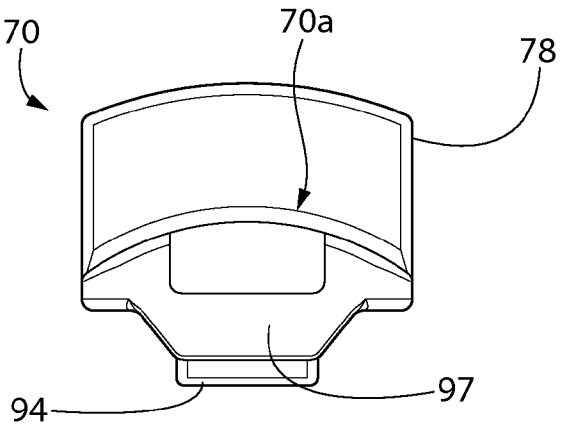
FIG. 22 is a front end view thereof.
Figure 19:
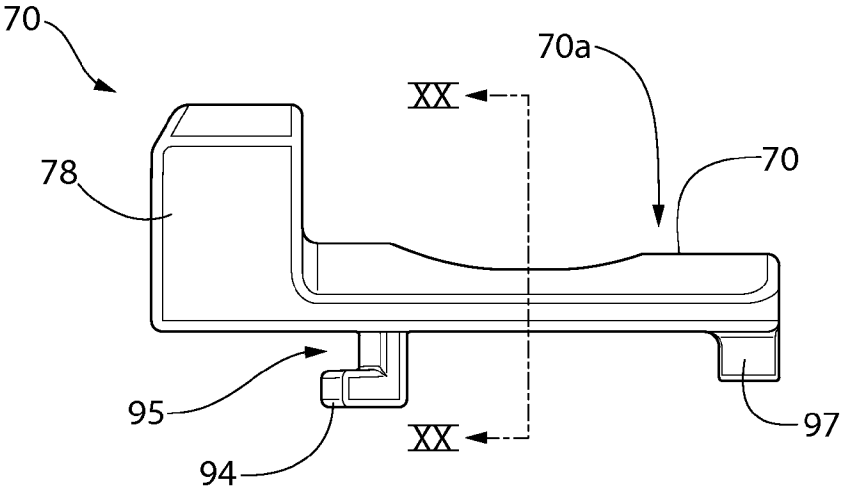
FIG. 19 is a side elevation view thereof.
Figure 21:
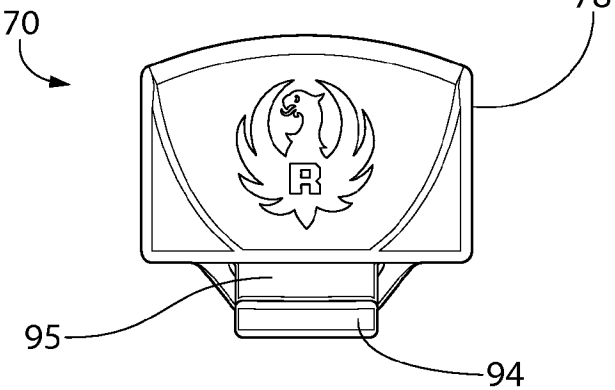
FIG. 21 is a rear end view thereof.
Figure 23:
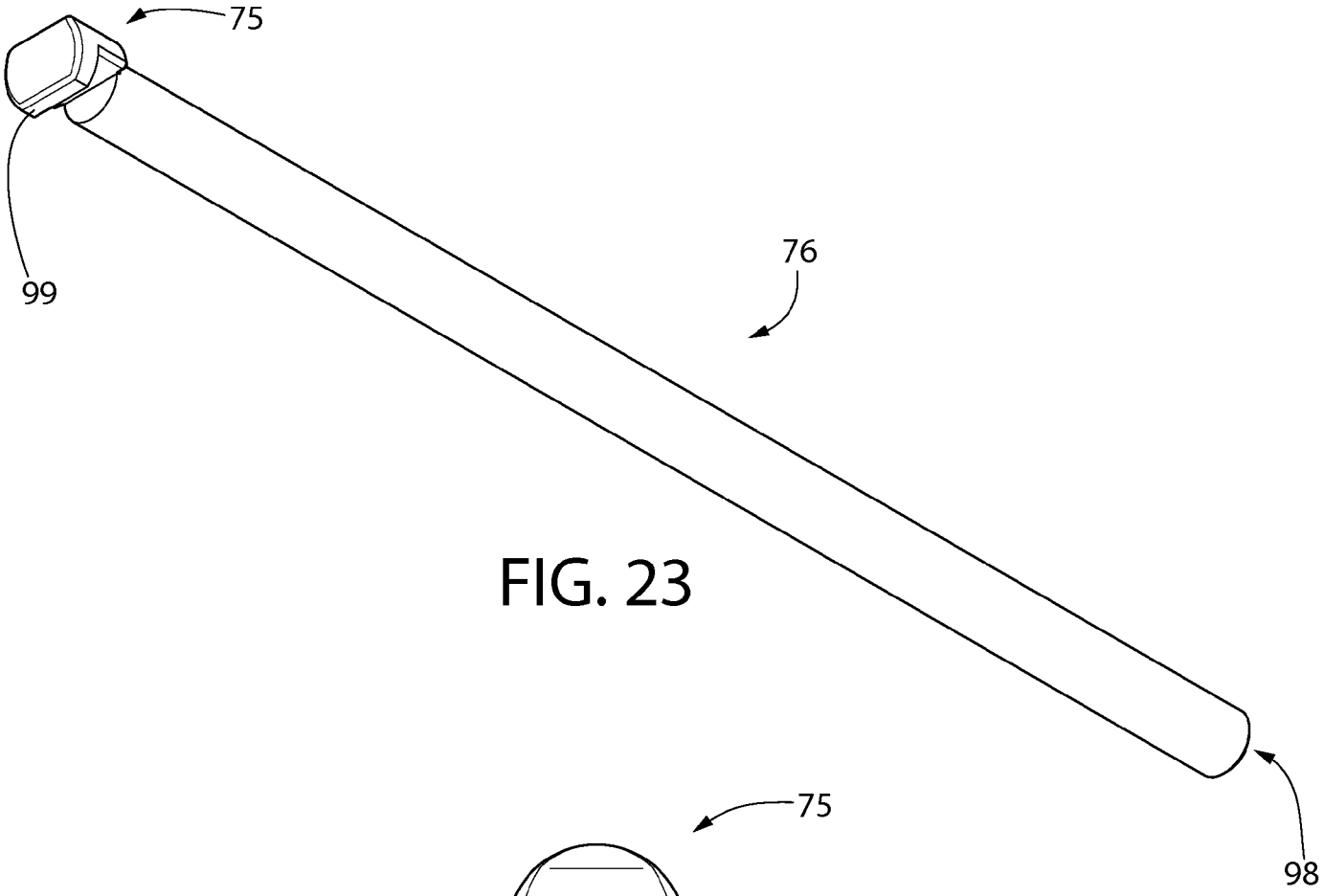
FIG. 23 is a bottom perspective view of a spring guide rod of the latching mechanism.
Figure 24:
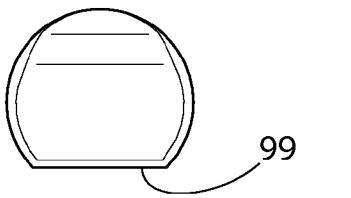
FIG. 24 is a rear end view thereof.
Figure 25:
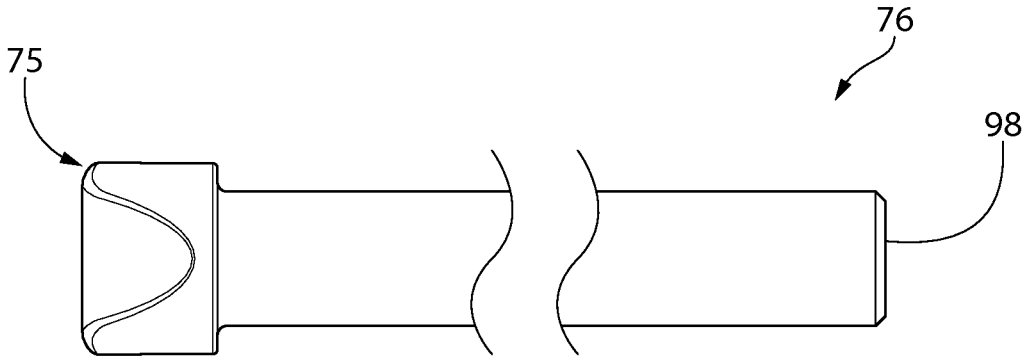
FIG. 25 is a top plan view thereof.
Figure 26:
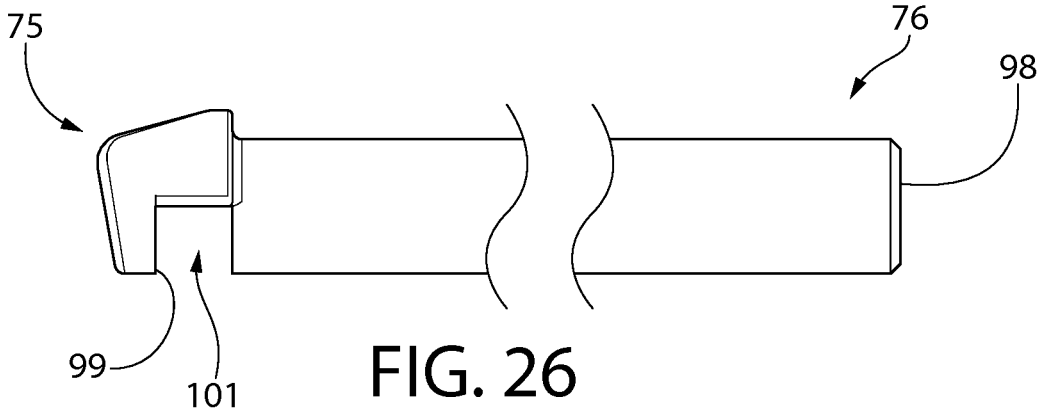
FIG. 26 is a side elevation view thereof.
Figure 27:
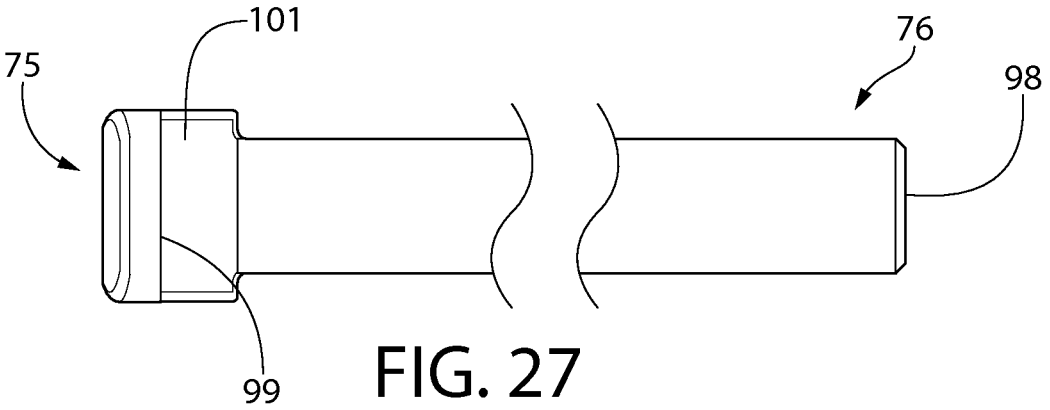
FIG. 27 is bottom plan view thereof.

Referring now to FIGS. 16-22, the locking portion of the slide plate 70 may be disposed forward of the actuator button 78 portion. The locking aperture 72 includes a pair of laterally spaced apart protruding locking ledges 91 which are configured and arranged to engage locking slot 81 of bolt stop pin 80 (see also FIG. 15). The ledges 91 project laterally inwards and rearward into locking aperture 72. Ledges 91 have a height H1 less than the height H2 of the slide plate 70 as best shown in FIG. 17. In this non-limiting embodiment, the ledges 91 have an arcuate shape and are spaced apart less than the diameter of the bolt stop pin 80 to engage the locking slot 81. In this arrangement, an open channel 92 is formed in slide plate 70 which is in communication with the forward portion of the locking aperture 72 to allow a part of the bolt stop pin 80 to enter the rear of the channel when the locking ledges 91 engage the locking slot 81. The channel 92 may be defined by opposing parallel straight sides 93 of the slide plate 70.

In an alternative embodiment, a single continuous arcuately shaped locking ledge 91' may be provided (represented in FIG. 16 by dashed lines) which is arranged to engage locking slot 81 of bolt stop pin 80. Such a ledge may be formed by simply joining the pair of ledges 91 with a central bridge piece having the same curvature to form a continuous arc in configuration. The channel 92 may optionally be omitted altogether in such an embodiment.

It will be appreciated that numerous other configurations of the slide plate 70 may be provided to selectively engage and disengage the locking slot 81 of bolt stop pin 80. It will further be appreciated that the latching mechanism may have other various configurations and is expressly not limited by the exemplary embodiments shown and described herein.

Figure 12:
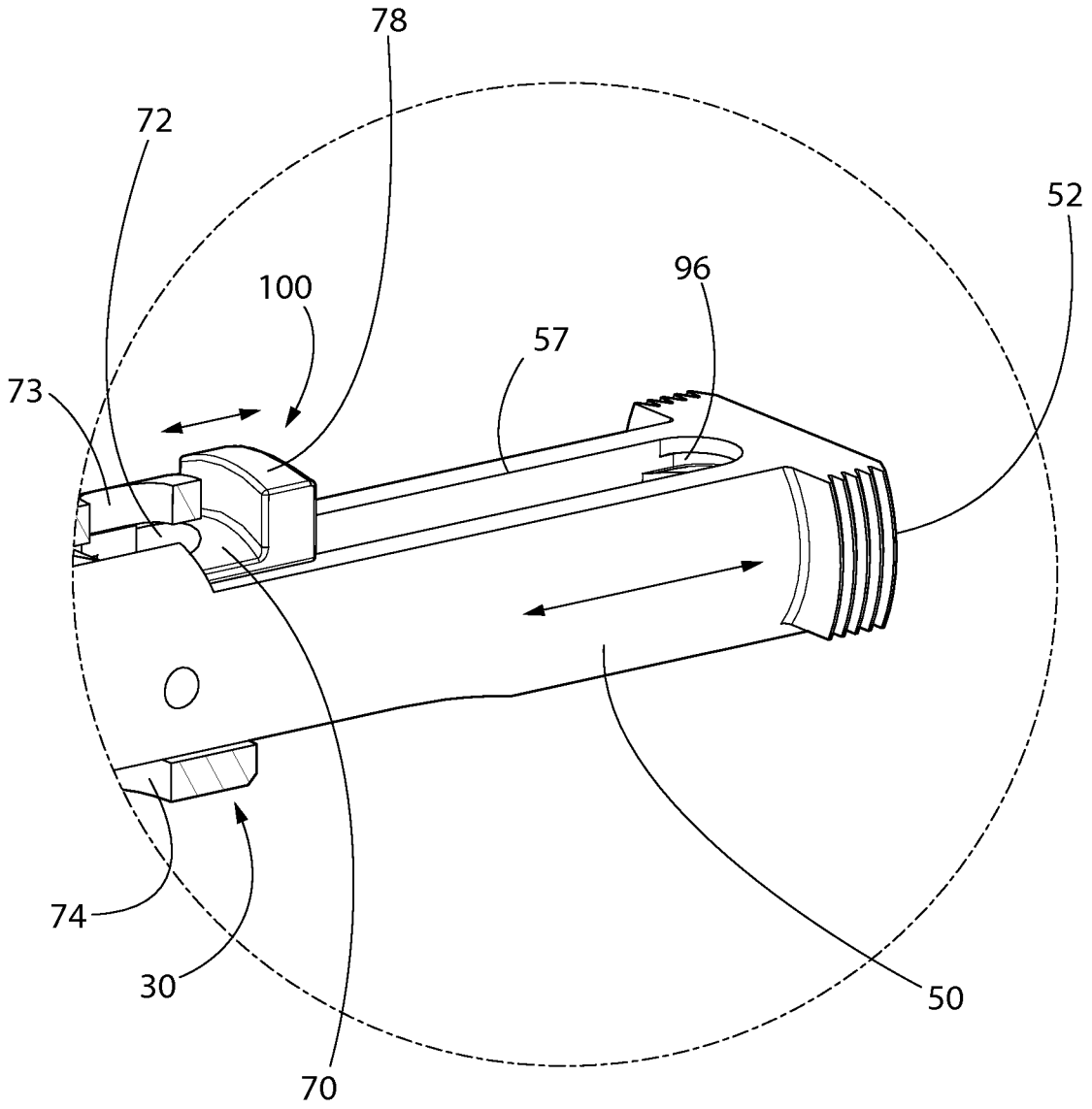
FIG. 12 is an enlarged perspective view of the rear end of the bolt and receiver thereof.
Figure 13:
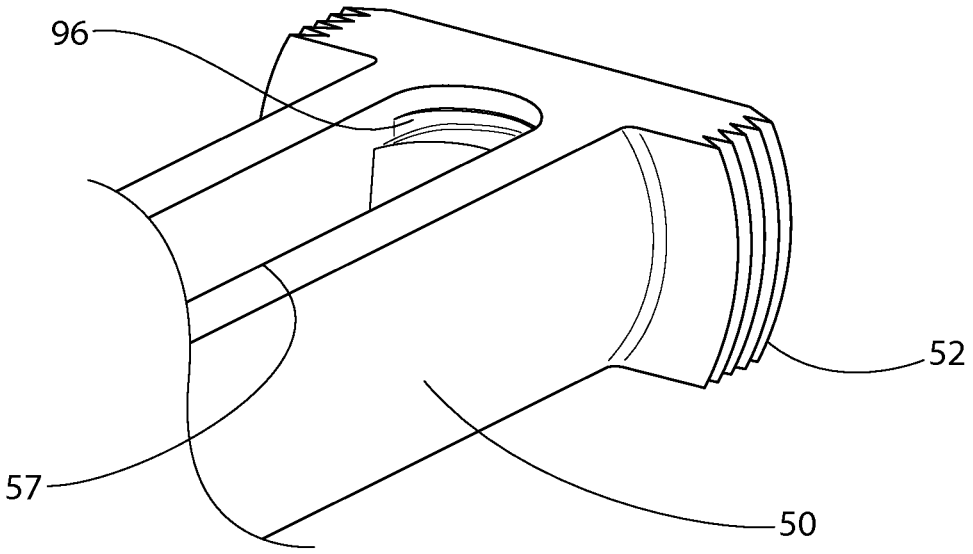
FIG. 13 is an enlarged perspective of the rear end of the bolt showing a socket.

With continuing reference to FIGS. 16-22 and further to FIGS. 12-14, slide plate 70 with actuator button 78 may include a tab 94 which is configured and arranged to engage a pocket 96 formed in the bolt 50. This arrangement helps maintain positive engagement between rear end of the slide plate 70 with the bolt 50 (when the bolt is locked during firing to form a closed breech) to prevent the rear end of the slide plate from popping up under the biasing action of the spring 77 on the slide plate and initial recoil forces. In one embodiment, the tab 94 projects rearward from and is an integral part of an L-shaped protrusion 95 projecting downwards from actuator button 78 behind the locking aperture 72. The pocket 96 is formed in the rear end of the bolt intermediate to the pair of bolt ears 52 behind slot 57. When the pistol 10 is fired, the bolt 50 travels rearward under recoil and the tab 94 leaves the pocket 96 as the breech is opened. The receiver interacts with the slide plate 70 to keep it in position during this time. When the bolt is eventually returned forward by recoil spring 58 (see FIG. 7), the tab 94 re-enters the pocket 96 and the breech is closed.

In some embodiments, without limitation, spring guide rod 76, slide plate 70, and bolt stop pin 80 may be made of a suitable metal and/or combination of metals such as without limitation steel including stainless steel, titanium, and or aluminum, in other possible embodiments, some or all of these components or portions thereof may be made of non-metallic materials such as without limitation unfilled or glass reinforced polymers.

In some illustrative embodiments, without limitation, barrel 20 may be made of a metal with suitable toughness and durability to withstand the combustion pressures and temperatures generated when firing the pistol. In some embodiments, without limitation, barrel 20 may be made of a suitable steel and alloys thereof. In configurations where the barrel-receiver assembly 20/30 is formed as a single monolithic and unitary structure, the receiver 30 is integral with the barrel 20 and formed of the same material. In other possible embodiments, where the barrel 20 and receiver 30 are formed as separate components which are mechanically joined together (e.g. threaded or interlocked connections, etc.), the receiver 30 may be made of a different material than the barrel such as relatively lighter-weight metal including aluminum, titanium, and alloys thereof to reduce the overall weight of the pistol 10. In one embodiment, receiver 30 may be made of 6061-T6 aluminum.

An exemplary method for opening and closing barrel-receiver assembly 20/30 of pistol 10 will now be described.

Referring to FIG. 1, barrel-receiver assembly 20/30 is shown in a downward closed and ready-to-fire operating position. Sliding plate 70 is in the rearward locked position engaged with locking slot 81 of bolt stop pin 80. To break open the barrel-receiver assembly for maintenance or other purposed, the slide plate actuator button 78 is first manually moved axially forward toward the muzzle end 23 of barrel 20. The actuator button 78, which acts on a rear end of the slide plate 70, pushes the slide plate in turn forward to the unlocked position. The slide plate 70 becomes disengaged from locking slot 81 of bolt stop pin 80 and frees the barrel-receiver assembly 20/30 to be moved pivotally with respect to the grip frame 12 of pistol 10 about pivot pin 60.

Next, the barrel-receiver assembly 20/30 is pivoted upwards and forward (counter-clockwise as shown in FIGS. 2, 3, and 5) about pivot pin 60. The rear end of the receiver 30 is displaced and vertically moved apart from the rear end of the grip frame 12. Barrel-receiver assembly is now in the upward angled open position. Barrel-receiver assembly 20/30 is tilted and angled with respect to the longitudinal axis of the pistol 10 in which bolt stop pin 80 is now disengaged completely from barrel-receiver assembly 23/30. The barrel-receiver assembly and portions of the grip frame 12 containing the firing mechanism and hammer assembly are now fully accessible to a user for inspection and maintenance.

To then close the barrel-receiver assembly 20, 30, the barrel-receiver assembly is pivoted downwards and rearward (clockwise as shown in FIGS. 1, 5, and 6) about pivot pin 60. The underside of slide plate 70 first engages the top of the bolt stop pin 80, which in one non-limiting embodiment may be rounded as shown. This automatically slides the slide plate 70 forward slightly against the biasing force of spring 77 so that the top portion of the bolt stop pin 80 may enter aperture 72 in the slide plate. Once the rear end of the slide plate 70 is axially aligned with locking slot 81 of bolt stop pin 80, the spring-biased slide plate will be free to move rearward and snap into the locking slot. Simultaneously, the bottom rear end of the receiver 30 abuttingly contacts and becomes fully seated on the top rear end of grip frame 12. Barrel-receiver assembly 20/30 is now returned to its closed and ready-to-fire operating position.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with tilting barrel-receiver assembly, the firearm comprising:

a longitudinal axis;

a frame;

a barrel-receiver assembly pivotably supported by the frame, the barrel-receiver assembly angularly movable between a tilted open position and a closed position; and a latching mechanism disposed in the barrel-receiver assembly, the latching mechanism including a slide plate configured and operable to selectively engage or disengage the frame;

the slide plate slideably movable between a locked position in which the barrel-receiver assembly is retained in the closed position, and an unlocked position in which the barrel-receiver assembly is movable to the open position:, and a vertically oriented latch pin mounted to the frame which is engaged or disengaged by the slide plate;

wherein the latch pin includes a locking slot that is engaged or disengaged by the slide plate.

2. The firearm according to claim 1, wherein the latch pin is further configured and arranged to engage a reciprocating bolt slidably disposed in the barrel-receiver assembly, the latch pin defining a bolt stop pin operable to arrest forward travel of the bolt.

3. The firearm according to claim 1, wherein the slide plate includes a locking aperture configured to engage or disengage the latch pin.

4. The firearm according to claim 1, wherein the slide plate includes a locking aperture configured to engage or disengage the locking slot of the latch pin.

5. The firearm according to claim 4, wherein the locking aperture defines a reduced height locking ledge that projects inwards into the aperture, the locking ledge being engageable with the locking slot of the latch pin to form the locked position.

6. The firearm according to claim 1, wherein a rear end of the barrel-receiver assembly pivots upwards and a front end of the barrel-receiver assembly pivots downwards when the barrel-receiver assembly is moved from the closed position to open position.

7. The firearm according to claim 1, wherein barrel-receiver assembly pivots about a pivot axis located forward of the trigger.

8. The firearm according to claim 1, wherein the slide plate is biased into the locked position by a spring.

9. The firearm according to claim 7, wherein the latching mechanism includes an axially elongated rod oriented along the longitudinal axis and coupled to a front end of the slide plate, the slide plate, spring, and rod being mounted in and movable with the barrel-receiver assembly.

10. The firearm according to claim 1, further comprising an actuator button integrally formed with the slide plate and projecting upwards from a top surface of the slide plate for moving the slide plate between the locked and unlocked positions.

11. The firearm according to claim 1, wherein:

the barrel-receiver assembly further includes an axially reciprocating bolt operable to form an open and closed breech; and the slide plate includes a tab projecting rearwards, the tab arranged to alternatingly engage and disengage a forwardly open socket formed in a rear end of the bolt when firing the pistol.

12. A pistol with tilting barrel-receiver assembly, the pistol comprising:

a longitudinal axis;

a grip frame defining a front trigger guard portion and a rear magazine well;

a barrel-receiver assembly pivotably supported by the frame, the barrel-receiver assembly including a barrel coupled to a receiver, the barrel-receiver assembly angularly movable between a tilted open position and a closed position;

a reciprocating bolt movably disposed in the barrel-receiver assembly for forward and rearward movement along the longitudinal axis;

a bolt stop pin rigidly attached to the frame, the bolt stop pin arranged to engage the bolt to limit the forward movement of the bolt; and a latching mechanism disposed in the barrel-receiver assembly, the latching mechanism including a slide plate configured and operable to slidably engage the bolt stop pin in a locking manner;

the slide plate axially movable between a locked position in which the slide plate engages the bolt stop pin to prevent the barrel-receiver assembly from being moved out of the closed position, and an unlocked position in which the slide plate disengages the bolt stop pin to allow the barrel-receiver assembly to move to the open position;

wherein the slide plate engages a locking slot formed in the bolt stop pin when the slide plate is in the locked position.

13. The pistol according to claim 12, further comprising a locking aperture formed in the slide plate, the bolt pin being insertable through the aperture and the locking slot engaging a locking ledge formed inside the aperture to lock the barrel-receiver assembly in the closed position.

14. The pistol according to claim 12, wherein the bolt stop pin is vertically oriented and insertable upwards through a locking aperture formed in the slide plate when the barrel-receiver assembly is in the closed position, a portion of the slide plate adjacent the aperture being configured to engage locking slot formed in the bolt stop pin.

15. A method for operating a firearm with tilting barrel-receiver assembly, the method comprising:

providing a firearm including a longitudinal axis and a frame supporting a barrel-receiver assembly pivotably movable from a closed position to a tilted open position;

moving the barrel-receiver assembly from the open to closed position;

inserting a latch pin disposed in the frame through a slide plate movably disposed in the barrel-receiver assembly;

axially sliding a slide plate in a first direction into mutual engagement with the latch pin; and locking the barrel-receiver assembly in the closed position wherein the barrel-receiver assembly cannot be moved to the open position:, wherein the inserting step includes inserting the latch pin through a locking aperture formed in the slide plate, a top end of the latch pin projecting above a top surface of the slide plate;

wherein the locking step includes engaging a locking ledge projecting into the locking aperture with a locking slot formed in the latch pin.

16. The method according to claim 15, further comprising a step of inserting the latch pin of the frame through a bolt movably disposed in the barrel-receiver assembly for reciprocating forward and rearward movement.

17. The method according to claim 16, further comprising a step of inserting a rearwardly projecting tab disposed on the slide plate into a forwardly open socket formed on the bolt.

18. The method according to claim 15, wherein the axially sliding step includes sliding the slide plate rearward into mutual engagement with the latch pin.

19. The method according to claim 18, further comprising:

axially sliding the slide plate in a second direction opposite the first direction;

disengaging the slide plate from the latch pin; and moving the barrel-receiver assembly from the closed position to the open position.

* * * * *